US006082320A

United States Patent [19]

Shimayama

[11] Patent Number: 6,082,320

[45] Date of Patent: Jul. 4, 2000

[54] CYLINDER BLOCK STRUCTURE

[75] Inventor: Yoshiro Shimayama, Fujisawa, Japan

[73] Assignee: Isuzu Motors Limited, Tokyo, Japan

[21] Appl. No.: 09/218,655

[22] Filed: Dec. 22, 1998

[30] Foreign Application Priority Data

Dec. 26, 1997 [JP] Japan ..... 9-360861

[51] Int. Cl.[7] ..... F02F 7/00; F02F 1/00

[52] U.S. Cl. ..... 123/195 R; 123/193.1; 123/193.3

[58] Field of Search ..... 123/195 A, 195 AC, 123/195 H, 195 R, 193.1, 193.2, 193.3, 193.5

[56] References Cited

U.S. PATENT DOCUMENTS

| | | | |
|---|---|---|---|
| 3,168,081 | 2/1965 | Bauer | 123/195 R |
| 4,419,970 | 12/1983 | Shaw | 123/13.74 |
| 4,653,761 | 3/1987 | Baugh et al. | 123/193.3 |
| 4,712,517 | 12/1987 | Anno et al. | 123/195 R |
| 4,903,646 | 2/1990 | Minagawa et al. | 123/55 |
| 5,664,538 | 9/1997 | Hutchins | 123/195 |

FOREIGN PATENT DOCUMENTS

| | | | |
|---|---|---|---|
| 58-202346 | 11/1983 | Japan | 123/193.3 |
| 63005146 | 11/1988 | Japan . | |
| 05039747 | 2/1993 | Japan . | |
| 6-129300 | 5/1994 | Japan | 123/193.2 |
| 60-81451 | 5/1995 | Japan | 123/193.2 |
| 08021299 | 1/1996 | Japan . | |

*Primary Examiner*—Erick Solis
*Assistant Examiner*—Brian Hairston
*Attorney, Agent, or Firm*—McCormick, Paulding & Huber LLP

[57] ABSTRACT

A plurality of head bolt holes (8) is formed in the top part (4) of a cylinder block (1) of an engine at prescribed intervals about the peripheries of cylinder bores (2). Female threads (8*b*) are formed in the head bolt holes (8) and wall buildups (9) are formed on side walls of the cylinder block (1) around the female threads (8*b*) respectively. Axial tension transmission members (10) are also formed on the cylinder block side walls between the wall buildups (9) so as to interconnect adjacent wall buildups (9). The axial tension produced in the female threads upon tightening of the head bolts is transmitted not only to the vicinities of head bolt holes (8), but also to intermediate areas (12) between adjacent head bolt holes, via the wall buildups (9) and axial tension transmission members (10). Thus, the top face (5) of the cylinder block (1) is uniformly pressed against the mating bottom face of the cylinder head even if the cylinder block is made of a material with small Young's modulus such as aluminum.

7 Claims, 5 Drawing Sheets

CYLINDER BLOCK STRUCTURE

BACKGROUND OF THE INVENTION

1. Field of the Invention

This invention generally pertains to a cylinder block structure of an engine and more particularly to a cylinder block structure featuring improved sealing with a cylinder head.

2. Description of the Related Art

The seal between a cylinder block and cylinder head of an engine is maintained by using head bolts to bolt down the cylinder head on the cylinder block with an intervening gasket. More specifically, the head bolts are inserted through the cylinder head and tightened down in the female threads of head bolt holes in the cylinder block such that axial tension develops in the female threads and is transmitted to the top deck of the cylinder block, whereupon the top face (sealing face) of the cylinder block is pressed against the cylinder head to form a seal.

In the interest of improving the seal, it is desirable that the axial tension which develops in the female threads due to tightening down the head bolts acts more or less uniformly over the entire sealing face. Conventionally, cast iron has been used as the cylinder block material in engines. Cast iron exhibits a large Young's modulus, wherefore the axial tension developing in the female threads is transmitted not only to the vicinity about the head bolt holes, but to the entire seal face, inclusive of the portions between neighboring head bolt holes, so that adequate sealing can be secured.

Due to the demand for lighter weight in vehicles in recent years, however, cylinder block material is being changed from cast iron to aluminum. Aluminum exhibits a smaller Young's modulus than does cast iron. For this reason, the axial tension developed in the female threads is concentrated about the periphery of the head bolt holes, and is not transmitted to the entire sealing face, resulting in uneven sealing forces. The sealing forces are particularly inadequate in the places lying intermediately between neighboring head bolt holes, wherefore there is a possibility of gas escaping from the cylinders through these places.

One possible approach for resolving this drawback is to increase the number of cylinder bolts and thereby narrow the intervals between head bolt holes. When the number of bolts is increased, however, restrictions are thereby placed on the numbers and shapes of intake and exhaust ports formed in the cylinder head, resulting in diminished design freedom.

SUMMARY OF THE INVENTION

An object of the present invention is to provide a cylinder block structure for an engine wherewith the concentration of axial tension developed in the female threads can be eased, without increasing the number of head bolts, so that the seal with the cylinder head can be improved.

According to one aspect of the present invention, there is provided a cylinder block structure comprising a cylinder block, a plurality of head bolt holes formed at prescribed intervals about the periphery of cylinder bores in the cylinder block, internal threads formed in prescribed lengths inside the head bolt holes respectively, wall buildups formed on side walls of the cylinder block around the internal threads respectively, and axial tension transmission members formed on the side walls of the cylinder block between each two adjacent wall buildups in such a manner that the axial tension transmission members connect the adjacent wall buildups. The axial tension transmission members are integral with the cylinder block side walls. When this structure is implemented, the axial tension that is produced in the female threads by tightening the head bolts is transmitted to the cylinder block side walls via the wall buildups and the axial tension transmission members, thereby pressing the top part of the cylinder block against the bottom of the cylinder head. Thus the axial tension developed in the female threads is transmitted not only to the vicinity of the head bolt holes, but also to the portions intermediate between adjacent head bolt holes, wherefore the entire sealing face of the cylinder block is uniformly pressed against the cylinder head. (A gasket is generally interposed between the cylinder block and cylinder head so that it is more practical to say that the gasket is uniformly pressed against the cylinder head.) In other words, the concentration of axial forces developing in the female threads can be eased or moderated so that the seal with the cylinder head can be improved without increasing the number of head bolts. Accordingly, even if the cylinder block is made of a material with a relatively small Young's modulus such as aluminum, a problem of gas leakage from an interface between the cylinder block and cylinder head would not occur due to insufficient sealing.

The axial tension transmission members may be formed integrally with the side walls of the cylinder block, for example, by casting. Further, the axial tension transmission members may have a configuration to completely fill in the spaces between adjacent wall buildups (e.g., lump shape). In either case, the axial forces developed in the female threads can be definitely transmitted to the cylinder block side walls via the wall buildups and axial tension transmission members, and the seal is further improved.

Instead of the lump shape, the axial tension transmission members may be provided in the form of ribs extending between adjacent wall buildups on the side walls of the cylinder block. When so configured, lighter weight can be realized without sacrificing sealing performance. It is preferred that these ribs comprise a plurality of horizontal ribs, at least one vertical rib crossing the horizontal ribs like a lattice, and diagonal ribs running from the wall buildups to the areas intermediate between head bolt holes. It should be noted that the horizontal, vertical or diagonal ribs can be dispensed with if the sealing performance is not deteriorated.

The cylinder block structure may also include cooling water channels formed about the peripheries of the cylinder bores. In such a configuration, it is difficult for the axial tension in the female threads to be conveyed to the intermediate areas between the head bolt holes (high-pressure sealing area) at the top of the cylinder block, because of the presence of the cooling water channels, but adequate sealing performance can still be secured by providing the wall buildups and axial tension transmission members.

The cylinder block may be made of aluminum. Aluminum has a smaller Young's modulus than does cast iron, wherefore the bolt axial tension readily becomes concentrated about the periphery of the head bolt holes, but such concentration is eased by providing the axial tension transmission members connecting the wall buildups with each other.

DETAILED DESCRIPTION OF THE INVENTION

Embodiments of the present invention are now described with reference to the attached drawings.

Figure 1:
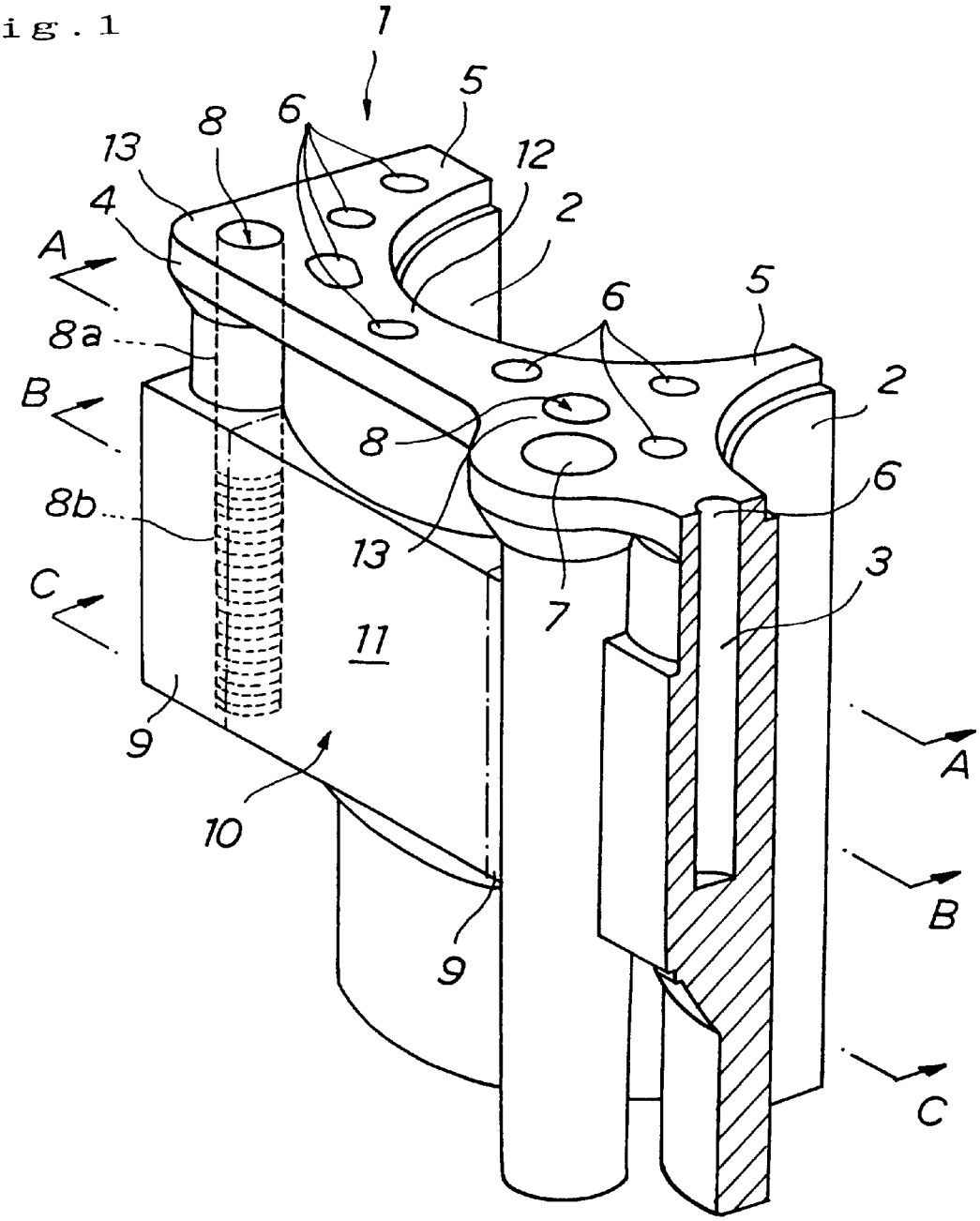
FIG. 1 illustrates a diagonal view of a cylinder block structure in one embodiment of the present invention.

Referring to FIG. 1, given is a partial diagonal view of an aluminum cylinder block 1 of an automobile engine. In this cylinder block 1 are formed a plurality of cylinder bores 2 (only a half of one of the cylinder bores 4 and a quarter of a next cylinder bore 4 are illustrated in the drawing). About these cylinder bores 2 are formed cooling water channels 3 in the shape of a jacket, as understood from FIGS. 1, 2A and 2B. These cooling water channels 3 pass through openings 6 formed in the sealing face 5 of the top part (top deck) 4 of the cylinder block 1 so as to communicate with cooling water channels (not shown) in a cylinder head (not shown).

Figure 2A:
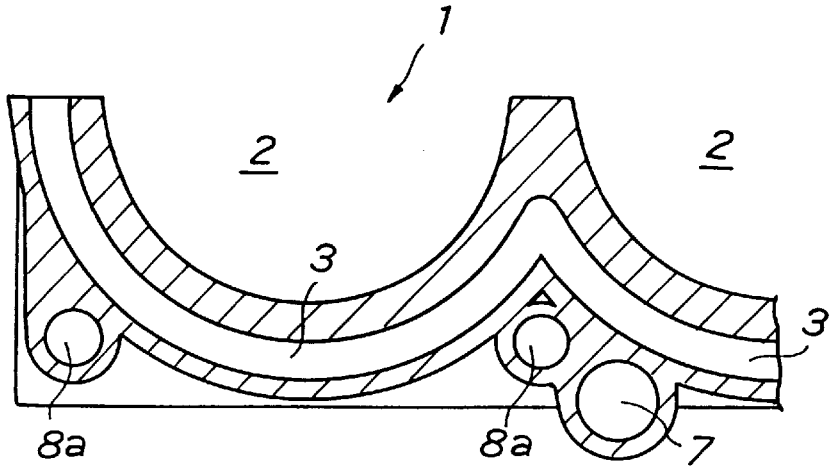
FIG. 2A illustrates a cross-sectional view in the A—A plane of FIG. 1.
Figure 2B:
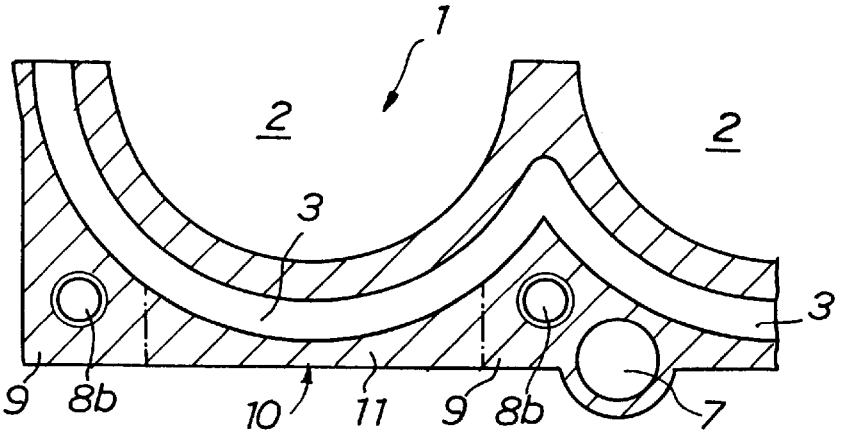
FIG. 2B illustrates a cross-sectional view in the B—B plane of FIG. 1.

As understood from FIGS. 1, 2A and 2B, the cylinder block 1 also has oil dropping channels 7 for dripping oil on the cylinder head side down to a crank case (not shown) at the bottom of the cylinder block 1. The oil dropping channels 7 open in the sealing face 5 at their upper ends and open into the crank case at lower ends. Thus the channels also function as blow-by gas channels carrying blow-by gas from the crank case up to the cylinder head.

In the cylinder block 1, a plurality of head bolt holes 8 are formed, at specified intervals about the peripheries of the cylinder bores 2. Head bolts (not shown) are passed through the cylinder head and screwed down into the head bolt holes 8. In this embodiment, four head bolt holes 8 are formed at four positions about each cylinder bore 2 in a square arrangement, but the number and locations of the head bolt holes are not limited thereto. For instance, there may five or more bolt holes drilled around each cylinder bore 2.

The upper part of each head bolt hole 8 is an ordinary hole 8*a* having no female threads, while in the lower or deep part thereof is formed a female thread (or internal thread) 8*b* of a prescribed length. Wall buildups 9 are formed on the sides of the cylinder block 1 around the female threads 8*b*. As diagramed in FIGS. 1 and 3, the wall buildups 9 extend over the entire length of the female threads 8*b*, from upper end to lower end.

Between each two adjacent wall buildups 9 and 9 is provided an axial tension transmission member 10 that connects the adjacent wall buildups 9 and 9 and also connects to the side of the cylinder block 1. In the illustrated embodiment, as diagramed in FIG. 1 to FIG. 3, each axial tension transmission member 10 includes a block body 11 that is formed integrally with the associated wall buildups 9 and 9 and fills in the space between these wall buildups 9 and 9.

The block body 11 is formed by casting, integrally with the cylinder block 1, together with the wall buildups 9. The left and right sides thereof, respectively, are united completely with the left and right wall buildups 9 and 9, while the inner surface thereof is joined completely with the side of the cylinder block 1. The block body 11 transmits the axial tension developed in the adjacent female threads 8*b*, when the head bolts are screwed into the bolt holes 8, to the area 12 of the sealing face 5 intermediate between adjacent head bolt holes 8 and 8. The area 12 is an area to which it is most difficult to transmit axial tension.

The working of the embodiment configured as described in the foregoing is now described.

When the cylinder head is mounted to the cylinder block 1, the head bolts passed through the cylinder head are inserted into the head bolt holes 8 and screwed down into the female threads 8*b*. At this time, axial tension is produced in the female threads 8*b* that pulls the member in the vicinity of that female threads 8*b* upward in the axial direction of the head bolt holes 3.

Figure 3:
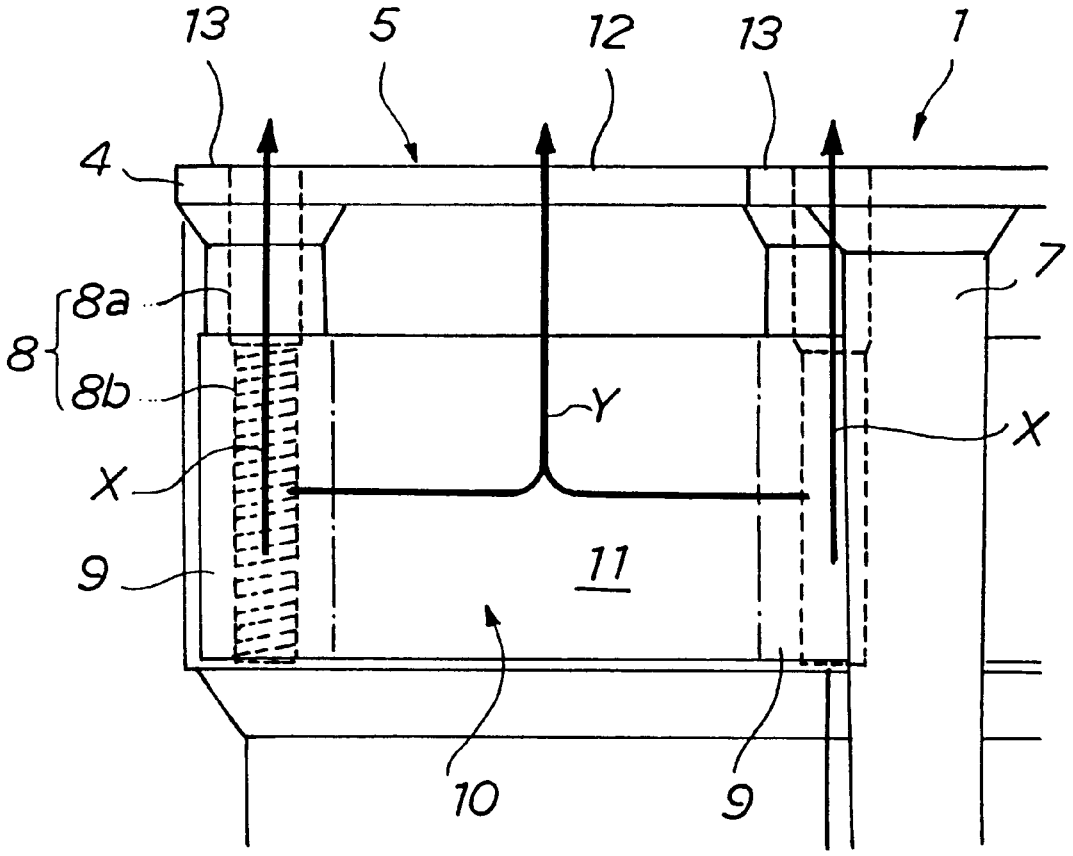
FIG. 3 illustrates a side elevation of the cylinder block structure diagramed in FIG. 1.

As best illustrated in FIG. 3, a part of this axial tension is transmitted upward along the head bolt holes 8 as indicated by the arrows X thereby pushing the sealing face 5 in the area 13 in the vicinity of those bolt holes 8 against the cylinder head, while the remainder thereof is transmitted to the side of the cylinder block 1 via the wall buildups 9 and 9 and the axial tension transmission member 10, as indicated by the arrow Y, pushing the sealing face 5 in the area 12 intermediate between adjacent head bolt holes 8 and 8 against the cylinder head.

In other words, the axial tension produced in the female threads 8*b* when the head bolts are screwed down into the head bolt holes 8 is transmitted not only to the vicinity of those head bolt holes 8, but also to the further areas 12 which lie between the head bolt holes 8 and 8. Regarding the axial tension transmission to the intermediate areas 12, the axial tension is first taken up by the wall buildups 9 and then transferred to the intermediate areas 12 via the axial tension transmission members 10. Accordingly, the entire sealing face 5 of the cylinder block 1 is pressed more or less uniformly against the bottom face of the cylinder head and concentration of axial tension is eased as compared with the conventional structure.

The wall buildups 9 are formed such that they extent completely over the female threads 8*b*, so that they take up the axial tension developed in the female threads 8*b* without loss. Each of the axial tension transmission members 10 includes the block body 11 the left and right sides of which are completely and integrally connected to the left and right wall buildups 9 and 9, respectively, and the inner surface of which is completely and integrally connected to the side wall of the cylinder block 1, wherefore it definitely transmits the axial forces taken in by the wall buildups 9 and 9 to the associated side wall of the cylinder block 1.

As a result, the axial tension of the female threads 8*b* is transmitted to the sealing face 5 of the cylinder block 1, distributed generally uniformly across the entire surface thereof, and the entire sealing face 5 is pressed against the cylinder head with uniform sealing forces. Thus seal performance is improved without increasing the number of head bolts. Or, to reason the other way around, the axial tension of the bolts can be reduced within a range wherein seal performance can be secured. Hence the overall wall thickness in the cylinder block 1 can be made thinner so as to realize lighter weight.

The areas 12 in the sealing face 5 intermediate between adjacent cylinder head bolt holes 8 and 8 are the most difficult areas to transmit the axial forces to, and also the places where combustion pressure gas inside the cylinder bores 2 is most apt to escape. When this embodiment is implemented, however, sufficient axial tension is transmitted to these areas 12 via the axial tension transmission members 10 and the wall buildups 9, wherefore gas will not escape, and definite seal performance can be guaranteed.

It should be noted that if additional head bolt holes 8 are provided in the intermediate areas 12, the problem of seal performance will be resolved, but this would restrict the shapes and/or locations of the intake and exhaust ports formed inside the cylinder head. Thus, this approach is difficult to implement in practice. When this embodiment is implemented, seal performance can be enhanced without increasing the number of head bolts, that is, without imposing any limitations on the shapes and locations of the intake and exhaust ports.

Figure 2C:
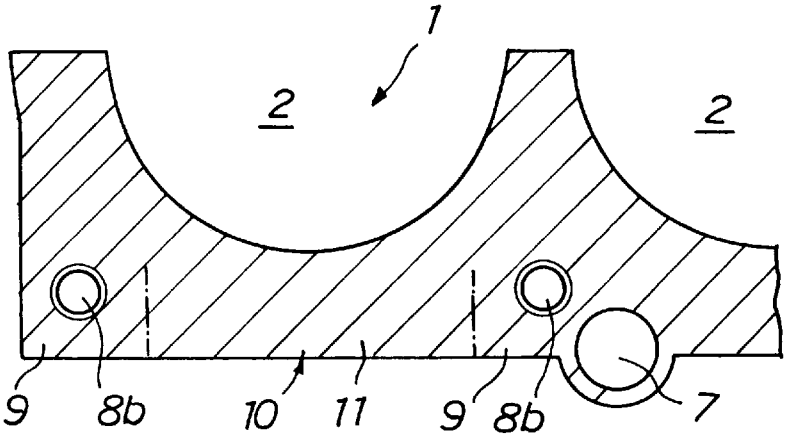
FIG. 2C illustrates a cross-sectional view in the C—C plane of FIG. 1.

In this embodiment, as illustrated in FIGS. 2A through 2C, the water cooling channels 3 are formed in the shape of a jacket about the peripheries of the cylinder bores 2 in the cylinder block 1. Rigidity is decreased by the existence of these cooling water channels 3. This makes difficult for the axial tension of the female threads 8*b* to be transmitted to the intermediate areas 12 in the sealing face 5 (high-pressure sealing areas). By providing the wall buildups 9 and associated axial tension transmission members 10 described in the foregoing, however, a force is produced in the direction of the arrow Y in FIG. 3, wherefore sufficient seal performance can be secured also in the intermediate areas 12.

It is also permissible to form the wall buildups 9 such that they extend upward so as to cover not only the female threads 8*b* but also the ordinary holes portions 8*a*, and to extend the axial tension transmission members 10 (block bodies 11) up to the top deck 4. In this modification, the wall buildups 9 and intermediate members 10 may also be molded together integrally with the cylinder block 1. If this is done, the rigidity of the upper part of the cylinder block 1 (which receives the shock of combustion in the cylinder bores 2) can be enhanced, thus improving durability and reducing noise.

Figure 4:
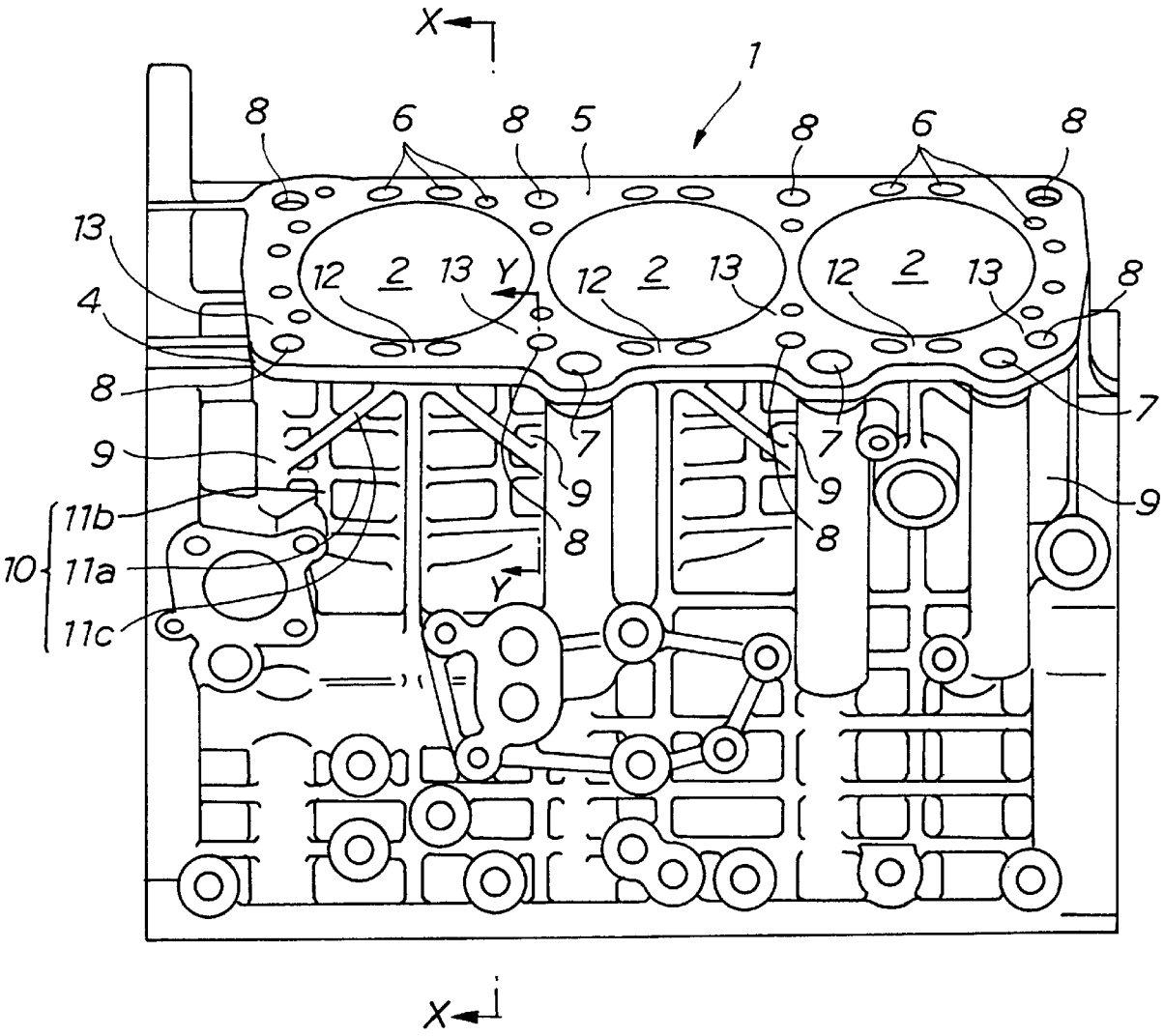
FIG. 4 illustrates a side elevation of a cylinder block structure used in a V6 engine, in another embodiment of the present invention.
Figures 5A, 5B:
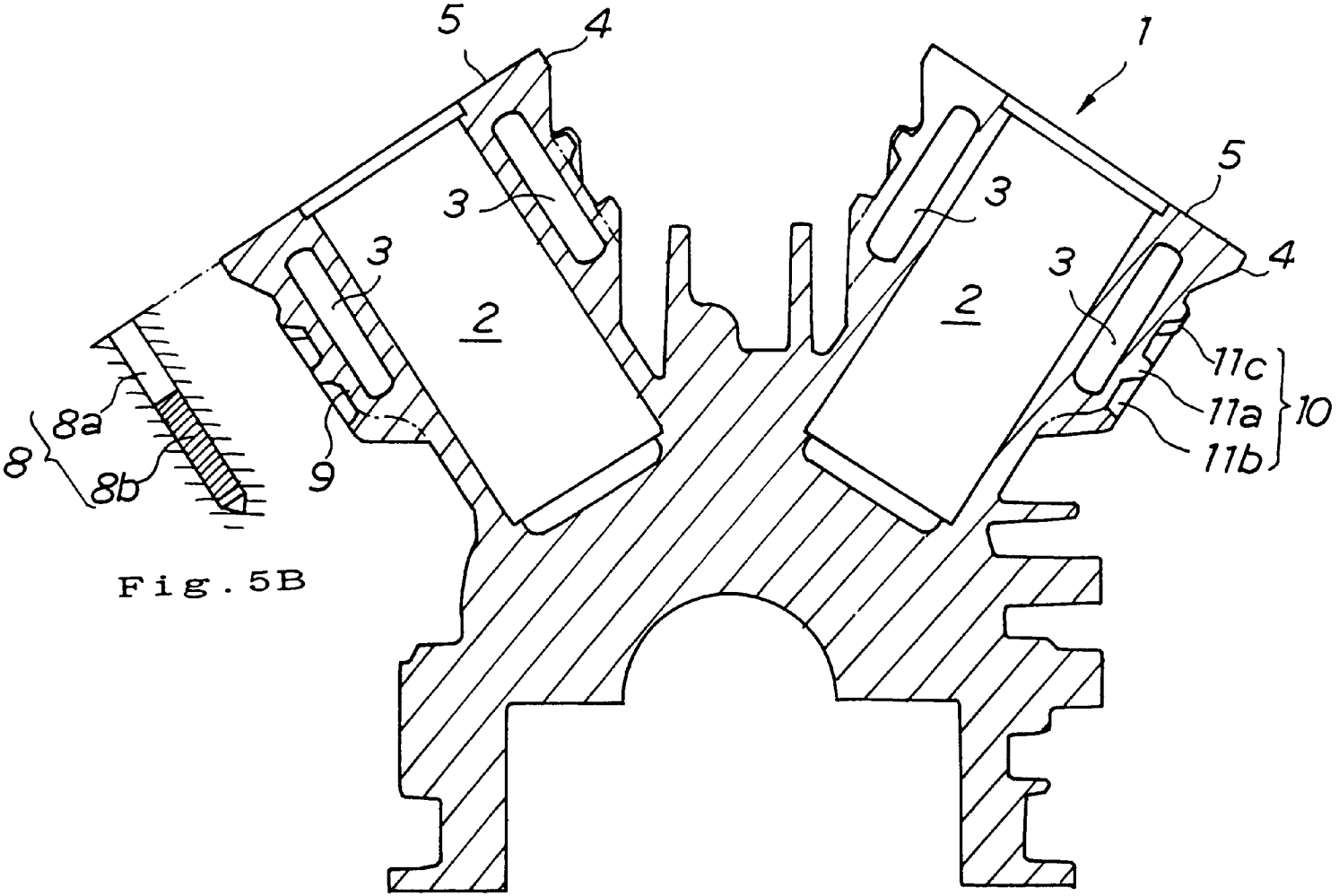
FIG. 5A illustrates a cross-sectional view in the X—X plane of FIG. 4.
FIG. 5B illustrates a cross-sectional view in the Y—Y plane of FIG. 4.

FIGS. 4, 5A and 5B in combination illustrate another embodiment of the present invention. This embodiment deals with a so-called V-6 engine having three cylinders on each bank of a cylinder block. Same or similar elements in the first and second embodiments have like reference numerals.

As understood from these drawings, six cylinder bores 2 are formed in left and right banks of the cylinder block 1 (three cylinder bores for each bank) in a V shape. About the peripheries of the cylinder bores 2 are formed cooling water channels 3, in the form of a jacket. The cooling water channels 3 pass through openings 6 formed in the sealing face 5 and thus communicate with cooling water channels in a cylinder head (not shown).

In the cylinder block 1 are formed oil dropping channels 7 for dripping oil from the cylinder head down to a crank case (not shown) at the bottom of the cylinder block 1. These oil dropping channels 7 open in the sealing faces 5 at their upper ends and open into the crank case at their lower ends, thus also functioning as blow-by gas channels carrying blow-by gas from the crank case up to the cylinder heads.

In the cylinder block 1, multiple head bolt holes 8 are formed, at specified intervals about the peripheries of the cylinder bores 2. Head bolts (not shown) are passed through the cylinder heads and screwed down into the head bolt holes 8. In this embodiment, four head bolt holes 8 are formed at four positions about each cylinder bore 2 in a square arrangement, but the number and locations thereof are not limited thereto. For example, there may be five or more cylinder bores.

As best illustrated in FIG. 5B, the upper part of each head bolt hole 8 is an ordinary hole 8*a* having no female threads, while in the deep part thereof is formed a female thread 8*b* of a prescribed length. Wall buildups 9 are formed on the side walls of the cylinder block 1 around the female threads 8*b*. The wall buildups 9 extend over the entire length of the female threads 8*b*, from upper end to lower end, and also extend over the ordinary hole portions 8*a*. This is also understood from FIG. 4.

Between each two adjacent wall buildups 9 and 9 is provided an axial tension transmission member 10 that connects these wall buildups 9 and 9 and also connects to the associated side wall of the cylinder block 1. Each axial tension transmission member 10 comprises horizontal ribs 11*a* formed about the peripheries of the cylinder bores 2, vertical ribs 11*b* formed in line with the axial directions of the cylinder bores 2, and diagonal ribs 11*c* formed from roughly the middle of each of the two associated wall buildups 9 to the middle of the top deck 4 between these wall buildups (intermediate area 12 between the adjacent head bolt holes 8 and 8).

This embodiment configured in this manner exhibits the same operational effectiveness as does the previous embodiment. That is, part of the axial tension that is produced in the female threads 8*b* by tightening down the head bolts acts to press the sealing face 5 in the areas 13 in the vicinity of the bolt holes 8 against the cylinder heads, via the wall buildups 9, while the remainder thereof acts to press the sealing faces 5 in the areas 12 intermediate between adjacent head bolt holes 8 and 8 against the cylinder heads, via the wall buildups 9 and the axial tension transmission members 10 (horizontal ribs 11*a*, vertical ribs 11*b*, and diagonal ribs 11*c*).

Thus sealing performance can be secured in the intermediate areas 12 without providing head bolt holes 8 in the intermediate areas 12. With this embodiment, moreover, each of the axial tension transmission members 10 consists of the horizontal ribs 11*a*, vertical ribs 11*b*, and diagonal ribs 11*c*, wherefore significant weight reduction can be achieved as compared to the block body 11 diagramed in FIG. 1.

The cylinder block structure illustrated and described above is disclosed in Japanese Patent Application No. H9-360861/1997 and the entire disclosure thereof is incorporated herein by reference. The subject application claims priority of this Japanese Patent Application.

What is claimed is:

1. A cylinder block structure for an engine, comprising:

a cylinder block;

a plurality of head bolt holes formed at prescribed intervals about a periphery of cylinder bores in the cylinder block;

a plurality of internal threads formed in prescribed lengths inside said head bolt holes respectively;

a plurality of wall buildups formed on the side walls of said cylinder block around said internal threads and covering the entire length of said internal threads so that the thickness of the cylinder block side walls become thicker at said wall buildups respectively; and axial tension transmission members formed on the side walls of said cylinder block between said wall buildups in such a manner that the axial tension transmission members connect adjacent wall buildups wherebv the thickness of the cylinder block side walls also becomes thicker at said axial tension transmission members.

2. The cylinder block structure according to claim 1, wherein each of said axial tension transmission members is a block body formed integrally with said wall buildups.

3. The cylinder block structure according to claim 1, wherein each of said axial tension transmission members includes at least one rib formed on the side walls of said cylinder block.

4. The cylinder block structure according to claim 3, wherein said rib includes a plurality of horizontal ribs extending between adjacent wall buildups, at least one vertical rib crossing the horizontal ribs, and diagonal ribs extending from the wall buildups to an intermediate portion of the head bolt holes.

5. The cylinder block structure according to claim 3, wherein said rib includes a plurality of horizontal ribs extending between adjacent wall buildups, and diagonal ribs extending from the wall buildups to an intermediate portion of the head bolt holes.

6. The cylinder block structure according to claim 1 further including cooling water channels formed in the cylinder block about the peripheries of said cylinder bores.

7. The cylinder block structure according to claim 1, wherein said cylinder block is made of aluminum.

* * * * *